US006494399B1

(12) United States Patent
Rautakorpi

(10) Patent No.: US 6,494,399 B1
(45) Date of Patent: Dec. 17, 2002

(54) METHOD AND APPARATUS FOR CONTROL OF REELING

(75) Inventor: Timo Rautakorpi, Espoo (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/600,929

(22) PCT Filed: Jan. 22, 1999

(86) PCT No.: PCT/FI99/00042

§ 371 (c)(1),
(2), (4) Date: Jul. 21, 2000

(87) PCT Pub. No.: WO99/37567

PCT Pub. Date: Jul. 29, 1999

(30) Foreign Application Priority Data

Jan. 22, 1998 (FI) ..... 980144

(51) Int. Cl.[7] ..... B65H 18/26
(52) U.S. Cl. ..... 242/541.7; 242/541.1
(58) Field of Search ..... 242/541.7, 541.4, 242/541.5, 541.6, 547, 541.1

(56) References Cited

U.S. PATENT DOCUMENTS

| | | | | |
|---|---|---|---|---|
| 4,335,439 A | | 6/1982 | St. Denis | 364/562 |
| 4,496,112 A | * | 1/1985 | Olsson et al. | 242/541.4 |
| 4,594,880 A | | 6/1986 | Murdoch et al. | 73/32 R |
| 4,634,068 A | | 1/1987 | Malkki et al. | |
| 4,811,915 A | | 3/1989 | Smith | |
| 4,817,883 A | | 4/1989 | Hoffmann et al. | |
| 5,475,887 A | * | 12/1995 | Moussalli | 242/419.4 |
| 6,036,137 A | * | 3/2000 | Myren | 242/541.7 |
| 6,189,825 B1 | * | 2/2001 | Mathieu et al. | 242/541.6 |

FOREIGN PATENT DOCUMENTS

| | | |
|---|---|---|
| DE | 4128706 | 3/1993 |
| EP | 0233389 | 8/1987 |
| EP | 0397594 | 11/1990 |
| FI | 884651 | 4/1990 |
| WO | 9220601 | 11/1992 |
| WO | 9315008 | 8/1993 |

* cited by examiner

*Primary Examiner*—John M. Jillions
(74) *Attorney, Agent, or Firm*—Steinberg & Raskin, P.C.

(57) ABSTRACT

In the method for controlling reeling in a reel-up of a paper web, a paper web (W) is guided via a rotating reeling cylinder (1) around a reel spoil (2) into a reel (R) in such a way that the paper web (W) is passed onto the reel via a nip (N) between the reeling cylinder (1) and the reel (R). The paper web (W) running onto the reel is subjected to a load by means of actuators of the reel-up, which load affects the structure of the reel and is controlled by means of measured variables determined during the reeling process. A reel density is used as the measured variable, the reel density being determined during the reeling process continuously or at intervals, wherein it is possible to implement a closed control loop.

16 Claims, 2 Drawing Sheets

METHOD AND APPARATUS FOR CONTROL OF REELING

FIELD OF THE INVENTION

The invention relates to a method for controlling reeling in the reel-up of a web. The invention also relates to an apparatus for controlling reeling in the reel-up of a web.

BACKGROUND OF THE INVENTION

The reel-ups of web-like materials are used for reeling a material passed as a continuous web into a tight reel, so that it can be transferred to further processing. For example in reel-ups of a paper web, a continuous paper web passed from a paper machine, coating machine or a corresponding paper processing apparatus is wound around a reel spool to form a reel. The web is brought onto the reel via a reeling cylinder which is arranged rotatable and against which the reel is pressed by means of a loading device provided in connection with the reel spool. Thus, the web enters the reel so that it is pressed in between the preceding layers of the reel and the mantle surface of the reeling cylinder. At this point, where the web enters in contact with the preceding layers of the reel, the web is subjected to a particular nip load, linear pressure, produced by the aforementioned loading device. In current reel-up types, the reel spool is also centre-driven, and by means of the torque of the reel spool it is also possible to affect the peripherical force of the web to be reeled.

The reeling nip between the reeling cylinder and the reel is primarily used to prevent air from entering the reel. By controlling the load applied to the web, it is, however, also possible to control the tightness of the roll that is building, and furthermore, the aim is to change the load during the reeling so that at different points of the radius of the reel, the tightness of the reel would correspond to the quality requirements set in accordance with the paper grade and after-treatment of the reel. The properties correlating with the tightness of the reel include reel hardness and reel density.

Methods for affecting the web in order to attain a suitable hardness or density distribution in the direction of the radius of the reel, are described for example in the Finnish patent 71107 in which the reel spool rests on supporting rails and is loaded towards the reeling cylinder, and this loading force is adjusted in such a way that the loading force is reduced e.g. in accordance with a predetermined loading program as the radius of the reel grows. When adjusting the loading force, one has to take into account the geometry of the loading mechanism, which requires a separate sensor application therein so that it is possible to make the necessary corrections when reducing the loading force. Moreover, other disturbing factors of the loading mechanism and the loading device which affect the actual load of the web, are disregarded.

Furthermore, the Finnish public patent application 884651 discloses a method in which the mass of the web reeled around the reel spool is continuously calculated so that it would be possible to take into account the effect of the weight of the reel when the reel is placed against the reeling cylinder before moving onto,the supporting rails where most of the reel is formed.

OBJECTS AND SUMMARY OF THE INVENTION

The purpose of the invention is to present a method of a new kind for controlling the reeling process during the entire process of reel formation. The purpose of the method is to eliminate the disturbance factors due to the mechanics, as well as other external disturbances, and to enable the reeling in such a way that each paper grade is provided with the correct density in different parts of the reel.

The control of the reeling process utilizes the reel density as a measured variable determining the load to be applied to the web. The reel density of the formed reel can be determined by measurements and calculations conducted with suitable sensors, either continuously or at sufficient frequent intervals.

Because the measured variable used is the reel density, i.e. the variable which is the final objective of the reeling process, it is possible to determine for each paper grade e.g. an optimal density curve, or, with respect to different purposes, optimal density curves as a function of the size (diameter or radius) of the reel. During the reeling process, this curve can be achieved as accurately as possible by taking the reel density corresponding to each momentary size of the reel as a set value and by changing the load applied to the web in such a way that this set value is attained.

Furthermore, the purpose of the invention is to present an apparatus for controlling the reeling process, by means of which the apparatus the aforementioned objectives to produce a reel with the desired density distribution are achieved. The apparatus constitutes a closed loop which comprises a calculating unit for calculating the reel density according to the measurement values issued by from a sensor, and a comparator and control unit for comparing the value with the set value and for adjusting the manipulated variables affecting the density on the basis of the information.

BRIEF DESCRIPTION OF THE DRAWINGS

In the following, the invention will be described in more detail with reference to the appended drawings, in which.

DETAILED DESCRIPTION OF THE INVENTION

Figure 1:
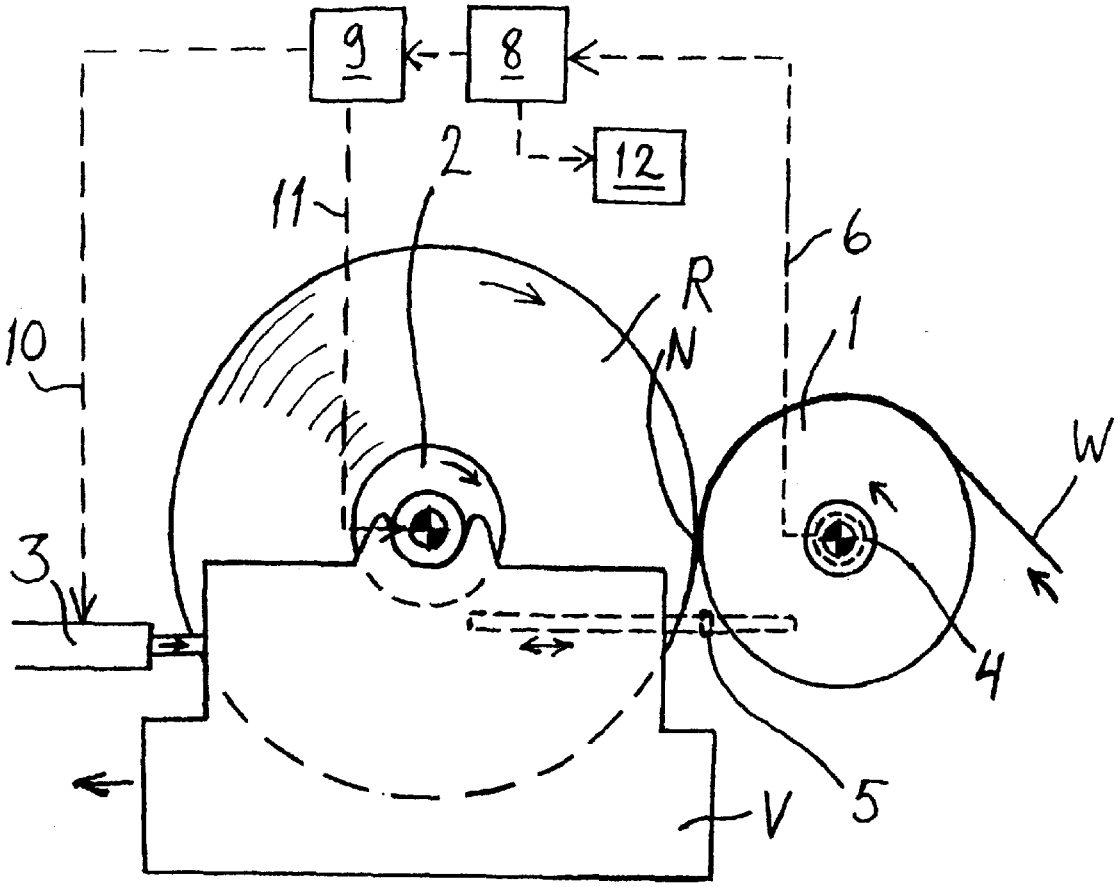
FIG. 1 shows a side view of a reel-up of a paper web applying the method according to the invention.

FIG. 1 shows schematically a reel-up of a paper web, a so called Pope-type reel-up, which continuously produces paper reels from a full-width web W passed from a paper machine or the like, one full paper reel being marked with the letter R in the figure. A rotating reeling cylinder 1, i.e. a Pope cylinder, guides the web W onto the reel R. The web W runs onto the reel R to be reeled via a reeling nip N between the layers lying just beneath in the reel R and the reeling cylinder 1. The reel R, located on the other side of the reeling cylinder 1 as seen in the travel direction of the web, is loaded against the reeling cylinder 1 in the radial direction by means of loading devices 3, e.g. hydraulic cylinders, known as such. The reel R is centre-driven, i.e. a reel spool 2 around which the reel R accumulates, is provided with a drive. The ends of the reel spool 2 are supported in a suitable way known as such.

The web W to be reeled onto the reel R is subjected to a load by means of a loading device directing force to the reel spool 2, and the force can also be transmitted to the web W by means of a special mechanism, such as a reeling carriage V. The force of the loading device 3 produces a particular loading force in the reeling nip N. Because this nip is situated on an axially oriented line of the reeling cylinder 1, the term linear load can be used for this loading force. A second force to be directed to the web W is a peripheral force which can be altered by changing the torque of the reel spool 2 that is being driven, and a third force affecting the web is web tension which can be produced by means of control devices associated with the web.

During the reeling process, the density of the reel R which is accumulated around the reel spool 2 is determined continuously or at suitable intervals. In this context, the term "determine" can be understood as being a combination of direct measurements and calculations, because the density is not a variable which could be measured directly e.g. by means of one sensor. Basically, however, the determination can also refer to the act of measuring the density directly, if such a system is or becomes available. The density of the reel at a given time is obtained by determining the change in the mass of the reel R within a certain period, and by dividing it with the change in the reel volume that has taken place within the respective period.

The change in the mass of the reel R can be calculated on the basis of the web width, grammage and web speed. The web speed can be derived from the rotational speed of the reeling cylinder 1 with a fixed diameter, or it can be measured in another way. The rotating speed of the reeling cylinder 1 is obtained from a sensor 4 measuring the rotating speed of the reeling cylinder, such as a tachometer, but it can also be determined in other ways. The width of the web W is a constant factor in the determination of the mass. The grammage can also be a constant term, but, if necessary, it can also be measured for example by means of a sensor located before the reeling cylinder 1. If the web speed is presumed to be constant, it can also be included as a constant factor in the calculation without departing from the basic concept of the invention, and in this case basically only time needs to be measured.

The change in the volume of the reel within the same interval can, in turn, be measured by measuring the increase in the thickness of the reel, i.e. the change in the distance between the reel spool 2 and the reeling nip N. This can be done by means of a suitable distance measurement sensor 5 which measures the change in the position of the spool 2 with respect to the reeling nip N. The sensor can be coupled for example between the reeling carriage V or any other structure moving along with the reel spool 2 and the supporting frame of the reeling cylinder 1, and for this purpose it is possible to utilize any sufficiently accurate sensors providing the position information. The sensor is advantageously a digital sensor, for example a high resolution digital absolute sensor. In case of digital sensors, an A/D converter is not required. Typically, the absolute sensor gives absolute position information because it is capable of reading a code which in each location of the sensor unambiguously gives the position of the sensor with respect to the part (code ruler) containing the code. Digital absolute sensors can also include sensors based on counting the pulses generated by the relative movements of the sensor and the second part. Similarly, it is possible to measure the distance by using an accurate distance measuring laser in which the measurement is conducted by means of a light beam. It is, however, also possible to use analog sensors which have a lower resolution and require an A/D converter. Analog sensors can be based on a potentiometer or on an inductive measurement. Instead of the aforementioned measuring sensors measuring the change in the distance (shift), the thickness of the reel can also be obtained by measuring the rotational speed of the reel spool 2 when the speed of the web W is known, which web speed can be presumed to be constant or measured in the way described above.

The increase in the volume of the reel R is naturally obtained as a volume of that cylinder whose inner diameter is the diameter of the reel in the beginning of the volume change measurement, and whose outer diameter is the diameter of the reel at the end of the volume change measurement. Here, the width of the web is naturally a constant factor.

The signal/signals obtained from the sensor 4 and/or other sensors used for measuring the change in the reel mass, are passed along a line 6 to a calculating unit 8 in which the change in the mass during the measuring time is calculated, wherein one variable used in the calculation is also the time elapsed. If, in addition to the web width, also the grammage and the web speed can be presumed to be constant, the change in the mass is calculated on the basis of these constant factors given to the calculating unit as well as the elapsed time. From the distance measurement sensor 5 or another sensor used for measuring the change in the volume, a signal is passed to the calculating unit 8 along a line 7, by means of which signal the change in the volume is calculated. On the basis of the received measurement signals, the calculating unit 8 conducts calculations on the basis of which the density of the reel produced during the measuring time is obtained. According to this information, the comparator and control unit 9 controls the loading device 3 affecting the nip pressure along a line 10, as well as an actuator affecting the peripheral force along a line 11, in accordance with an internal calculating method of the unit on the basis of the set value of the reel density given to the comparator and control unit.

The calculating unit 8 can also receive other information, which is not used for calculations to determine the density. It can also collect information from other sensors situated in connection with the reel-up, conduct calculations on the basis of this other information, possibly by combining it with the information obtained from the aforementioned sensors used for determining the density, as well as record this other information and/or the results of the calculations conducted by means of the other information.

The intervals in which the changes that have taken place are measured, can be very short, and the density measurements can be made at intervals immediately succeeding each other, wherein the density of the reel is, in practice, monitored continuously. The calculating unit can also process the value of the density based on the value of mass per volume (m/V) in order to produce a measured variable to be used for the actual adjustment; for example, it is possible to utilize filtering measurement. Thus, for example, the obtained value is supplemented with a certain portion of new dm/dV data in order to prevent the system from fluctuating. Similarly, it is possible to supplement the calculating unit 8 with a storing device 12 by means of which it is possible to store the achieved density in a memory as a function of the thickness of the reel for future use of the reel.

Figure 2:
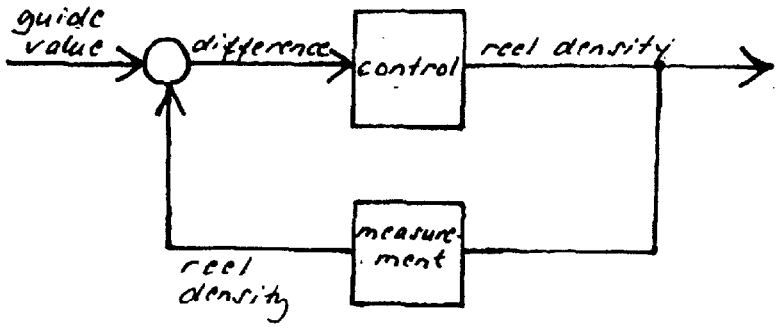
FIG. 2 shows a control principle schematically.

The process is illustrated in the diagram of FIG. 2. In this context, the measured variable refers to a variable obtained from the process by means of various measurements and calculations, the value of the variable being used for controlling the process. By means of the above-presented principle, the reeling process becomes a closed control loop, because the measured variable, the reel density, is obtained from the product of the reeling process, i.e. the machine reel, and the predetermined ideal values of this variable can be used as set values for the adjustment.

Figure 3:
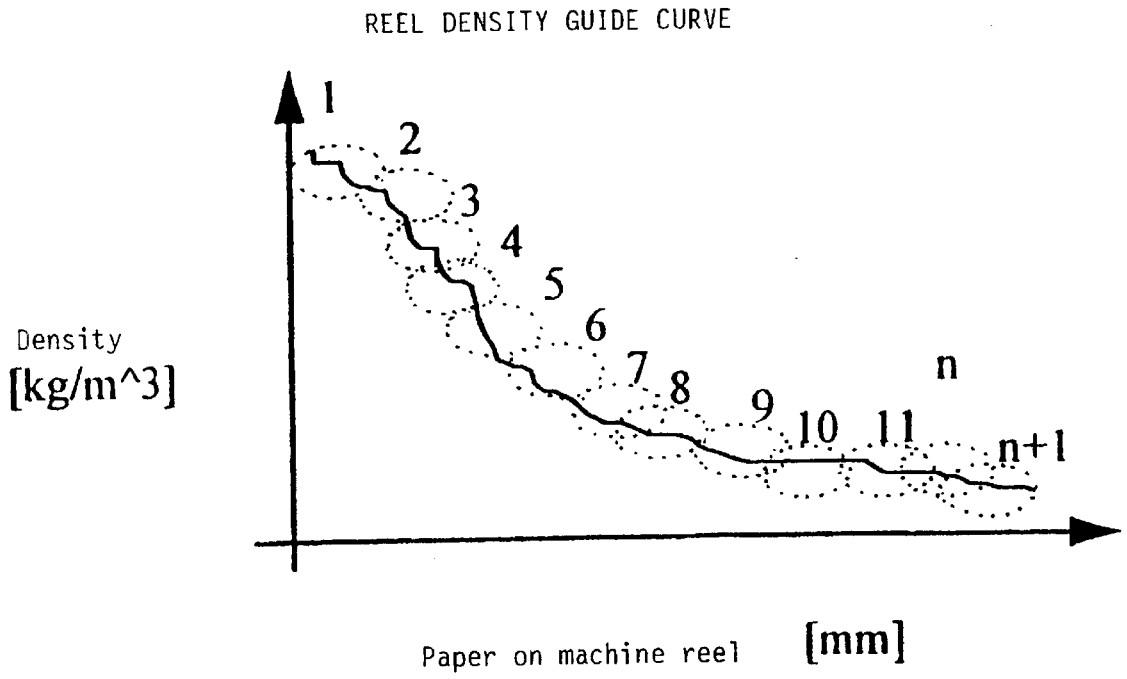
FIG. 3 is an example of a guide curve on the reel density utilized in the method.

FIG. 3 shows one guide curve for the reel density, which curve is an empirically measured density curve as a function of the diameter. In the curve, the density of the reel is indicated on the vertical axis and the thickness of the reel on the horizontal axis. The curve can also be more rectilinear, devised for example by means of an empirically attained curve. As can be seen in the figure, the general objective is that the reel density decreases when the radius of the reel increases, and each paper grade may have typical optimal curves (distributions of the optimal density, in accordance of which the density of the reel is reduced when the reel grows). In accordance with the grade of the paper web to be reeled, a guide curve for the reel density according to FIG. 3 is entered in the comparator and control unit 9. The respective set value of the density is determined according to the thickness of the reel R at a given time, the thickness being obtained in the above-described measurements, for example by means of the distance measurement sensor 5. Thus, the set value of the reel density used by the comparator and control unit 9 changes when the radius of the reel changes.

By means of the curve, it is possible to conduct the adjustment according to the following principle:

1) $density_{1,guide}$=the value of the guide curve for the reel density when the paper on the machine reel value is 1
   $density_{1,measured}=(mass_1/volume_1)=f(speed_1, web\ width_1, grammage_1)/f(diameter_1)$ or more generally: $density_{1,measured}=f(speed_1, web\ width_1, grammage_1, diameter_1)$
   $\rightarrow deviation\ value=density_{1,guide}-density_{1,measured}\rightarrow$linear load guide=1
   $\rightarrow$peripheral force guide=1

2) $density_{2,guide}$=the value of the guide curve for the reel density when the paper on the reel value is 1
   $density_{2,measured}=(mass_2/volume_2)=f(speed_2, web\ width_2, grammage_2)/f(diameter_2)$ or more generally: $density_{2,measured}=f(speed_2, web\ width_2, grammage_2, diameter_2)$
   $\rightarrow deviation\ value=density_{2,guide}-density_{2,measured}\rightarrow$linear load guide=2
   $\rightarrow$peripheral force guide=2

In the method, the load directed to the web to control the reel density is composed of the linear load in the nip and the peripheral force, and these manipulated variables can be changed in ways described above by means of the actuators of the reel-up in order to change the reel density. The initial value of the peripheral force is a certain, predetermined portion of the web tension, and the initial value of the linear load is the linear load upon closing the nip. The web tension is maintained advantageously constant, but it can also be adopted as a manipulated variable in the process by means of a corresponding actuator. The peripheral force and the linear load are controlled for example on the basis of empirical information, or by modelling a principle which is known to be useful.

By means of suitable reel-ups it is possible to map paper grade specific guide curves for the reel density, i.e. reference reel density curves, and when new reels of the same paper grade are reeled, these curves or their approximates can be used as optimal curves determining the set values. Furthermore, it is possible to determine different reference reel density curves for the same paper grade, the curves depending on the further processing of the reel.

In the apparatus, it is possible to use known instrumentation and data transmission solutions of process automatics. The calculating unit 8 and the comparator and control unit 9 can constitute functional parts of a fast computer used as a central processing unit for the apparatus, and as the storing device 12 it is possible to use the memory of the computer from which the information of each reel can be retrieved, copied or transmitted forward along data transmission lines.

The invention is not restricted solely to the solutions presented above, but it can be modified within the scope of the inventive idea presented in the following claims. The invention includes all suitable known sensor solutions and new future sensor types which can be used in this invention. Similarly, the invention is applicable to all materials in the form of a continuous web, especially a paper web. In this context, the term paper web refers to all reelable webs of fibrous raw material irrespective of the grammage.

What is claimed is:

1. Apparatus for controlling a reeling process in a reel-up of a paper web comprising:

a reel spool (2) supported at least at its ends, actuators for applying a load to the paper web running through a reeling nip onto a reel (R) having a growing size around the reel spool (2), means for determining measured variables of the reeling process and means for controlling the actuators on the basis of the determined measured variables, wherein the means for determining the measured variables comprise measuring sensors and a calculating unit (8) coupled to the sensors, said calculating unit being structured and arranged to calculate a reel density which is used as a measured variable, on the basis of measurement data transmitted by the sensors from the reeling process, wherein the means for controlling the actuators comprise a comparator unit and control unit (9) which is connected to the calculating unit (8), contains information on a desired reel density in set values as a function of the growing size of the reel, and is arranged to compare the determined reel density with the set value and to control the actuators on the basis of the comparisons, wherein the actuators to be controlled comprise a loading device (3) affecting a linear load in the reeling nip (N) and/or an actuator affecting a peripheral force through a torque of the reel spool being driven, and wherein the information on a desired reel density in set values as a function of the growing size of the reel is a decreasing reel density with a growing size of the reel.

2. Apparatus according to claim 1, wherein the calculating unit (8) is arranged to calculate the reel density on the basis of the change in the mass and volume of the reel.

3. Apparatus according to claim 2, wherein to determine the change in the volume of the reel (R), the measuring sensors comprise a distance measurement sensor (5) measuring the change in the size of the reel (R).

4. Apparatus according to claim 3, wherein the distance measurement sensor (5) is a digital sensor.

5. Apparatus according to claim 2, wherein to determine the change in the volume of the reel (R), the measuring sensors comprise a sensor measuring the rotating speed of the reel spool (2) constituting the core of the reel.

6. A method for controlling reeling in a reel-up of a paper web, comprising the steps of:

guiding a paper web via a rotating reeling cylinder around a reel spool into a reel in such a way that said paper web is passed onto said reel via a nip between said reeling cylinder and said reel;

subjecting said paper web running onto said reel to a load by means of actuators of said reel-up, which loads affects the structure of said reel and is controlled by means of measured variables determined during said reeling process while said reel is supported at least at either ends of said reel spool, wherein the density of said reel is used as a measured variable, said reel density being continuously determined or determined at intervals, whereby in the control, the desired reel density as a function of the size of said reel is used as a set value;

controlling said load on said paper web by controlling the linear load effective in said nip between said reeling cylinder and said reel and/or by controlling a peripheral force through a torque of the reel spool being driven; and wherein the desired reel density as a function of the size the reel is a decreasing reel density as a growing size of the reel.

7. The method according to claim 6, wherein determining the density of said reel further comprises the steps of:

determining the change in the mass of said reel;

determining the change in the volume of said reel; and dividing said determined change in mass by the determined change in volume of said reel.

8. The method according to claim 7, wherein determining said mass of said reel further comprises the steps of:

determining the width of said paper web;

determining the grammage of said paper web being reeled;

determining the speed at which said paper web is reeled onto said reel.

9. The method according to claim 8, wherein said speed of said reeling is based on the rotational speed of said reeling cylinder.

10. The method according to claim 7, wherein said step of determining the change in size of said volume further comprises the steps of:

determining the increase in thickness in the radial direction of said reel web.

11. The method according to claim 6, further comprising the step of:

utilizing a paper-grade-specific guide curve, unique to said reel density used, determining set values for said reel density from said curves as a function of said reel's size and the grade of said paper to be used.

12. An apparatus for controlling reeling a reeling process in a reel-up of a paper web, comprising:

a reel spool supported at its ends;

a plurality of actuators for applying a load to said paper web running onto a reel around said reel spool;

means for determining measured variables of said reeling process;

means for controlling said actuators relative to said measured variables, wherein, said means for determining said measured variables of said reeling process include a plurality of measuring sensors and a calculating unit coupled to said measuring sensors, whereby, said calculating unit is arranged to calculate the density of the reel which is used as a measured variable;

wherein said means for controlling said actuators include a comparator and control unit connected to said calculating unit, said control unit having information on the desired reel density in set values as a function of the size of said reel and is structured and arranged to compare said determined reel density with said set value and to control said actuators based on said comparison;

wherein said actuators further comprise a loading device for affecting the linear load in said reeling nip and/or an actuator for affecting a peripheral force through a torque of the reel spool being driven; and wherein the information on the desired density of the reel in set values as a function of the size of the reel is a decreasing reel density with a growing size of the reel.

13. The apparatus according to claim 12, wherein the calculating unit is configured to calculate the density of said reel on the basis of the change in the mass and volume of said reel.

14. The apparatus according to claim 13, wherein said measuring sensors further comprise a distance measurement sensor for measuring the change in the size of said reel.

15. The apparatus according to claim 14, wherein said distance measurement sensor is a digital sensor.

16. The apparatus according to claim 13, wherein said volume measuring sensor comprise a sensor for measuring the rotational speed of said reel spool.

* * * * *

UNITED STATES PATENT AND TRADEMARK OFFICE

CERTIFICATE OF CORRECTION

PATENT NO. : 6,494,399 B1
DATED : December 17, 2002
INVENTOR(S) : Rautakorpi, Timo It is certified that error appears in the above-identified patent and that said Letters Patent is hereby corrected as shown below:

Column 7,
Lines 2-3, “loads affects” should read -- load affects --.

Signed and Sealed this

Twenty-second Day of April, 2003

JAMES E. ROGAN
*Director of the United States Patent and Trademark Office*